US006000324A

United States Patent [19]

Grimm

[11] Patent Number: 6,000,324

[45] Date of Patent: Dec. 14, 1999

[54] METHOD AND DEVICE FOR SMASHING ALUMINUM CANS

[76] Inventor: Brad H. Grimm, 12144 Old Hwy. 60, Burbank, Okla. 74633

[21] Appl. No.: 09/250,926

[22] Filed: Feb. 18, 1999

[51] Int. Cl.[6] ..... B30B 9/32

[52] U.S. Cl. ..... 100/35; 100/210; 100/211; 100/902; 206/427; 206/446; D15/123

[58] Field of Search ..... 100/35, 193, 210–212, 100/233, 902; 206/139, 437, 446; D15/123

[56] References Cited

U.S. PATENT DOCUMENTS

| | | | |
|---|---|---|---|
| 225,467 | 3/1880 | Detwiler | 100/212 |
| 254,838 | 3/1882 | Peacock | 206/427 |
| D. 268,761 | 4/1983 | Brown . | |
| D. 342,265 | 12/1993 | Rock | D15/123 |
| 995,939 | 6/1911 | Anderson | 100/211 |
| 3,901,141 | 8/1975 | Bochmann | 100/902 |
| 4,333,397 | 6/1982 | Modes . | |
| 4,358,994 | 11/1982 | Talley . | |
| 4,561,351 | 12/1985 | Ader . | |
| 5,158,013 | 10/1992 | Morris . | |
| 5,337,907 | 8/1994 | McKenzie et al. | 206/427 |

FOREIGN PATENT DOCUMENTS

| | | | |
|---|---|---|---|
| 2553684 | 4/1985 | France | 100/35 |
| 7-75899 | 3/1995 | Japan . | |
| 8-155690 | 6/1996 | Japan . | |

*Primary Examiner*—Stephen F. Gerrity
*Attorney, Agent, or Firm*—Molly D. McKay

[57] ABSTRACT

A device for smashing empty aluminum cans that provides for holding the cans horizontally on the ground while an automobile runs over the cans in order to smash the cans into a flattened configuration for recycling. The device is comprised of a long, narrow backing and a flexible member that is secured to a top surface of the backing. The flexible member is formed into a series of parallel curved flaps for removably holding the cans across the width of the backing and in the path of travel of the automobile. The flexible flaps are resilient and they return to their original configuration after the automobile has run over the device, allowing the smashed cans to be removed from the device and the device to be reused.

9 Claims, 2 Drawing Sheets

METHOD AND DEVICE FOR SMASHING ALUMINUM CANS

BACKGROUND OF THE INVENTION

1. Field of the Invention

The present invention relates to a device for smashing aluminum cans. More specifically, the present invention is a device for holding aluminum cans so the cans can be run over by an automobile, thus smashing or crushing the cans into a flatten configuration for recycling.

2. Description of the Related Art

Recycling of aluminum cans is an environmentally responsible activity and some people collect and recycle aluminum cans to earn extra money. Because aluminum cans are hollow, they are bulky and hard to handle and transport. For this reason, it is desirable to smash empty aluminum cans into a flattened configuration so that they are easier to store and transport.

Various devices have been devised for smashing aluminum cans. Some of these devices require the user to exert pulling or pushing force on a lever provided on the device in order to flatten a can contained within the device. Children and some adults may find these types of lever operated devices hard to operate.

Other devices for smashing aluminum cans are mechanized and are provided with power means for flattening a can. Each of these types of devices requires some type of motor, usually an electrically powered motor, in order for the device to function. Devices that require motors are expensive.

None of the existing devices are designed to employ a relatively free source of energy to smash cans, such as for example, the force exerted by tires and the weight of an automobile as the automobile moves. However, one problem with smashing aluminum cans by running over the cans with tires of an automobile is that the cans tend to move or be shot out from under the approaching tire.

The present invention addresses this problem by providing a device that successful holds empty aluminum cans in place in the path of an approaching automobile tire, allowing the tire to roll over the cans and smash them flat. The present device is provided with a flat surface onto which the empty cans are placed and flexible concave covers that extend over the empty cans in order to hold the cans against movement as the fire approaches. The passing tire flattens both the flexible concave covers and the aluminum cans, but the flexible concave covers return to their original configuration after the tire passes over them. The concave covers also protect the tires from being damaged by the aluminum cans as they are crushed. The cans, however, are permanently smashed into a flattened configuration and can easily be removed from the device and the device can hung vertically to make it easier to be reloaded with additional empty cans that need to be smashed.

SUMMARY OF THE INVENTION

The present invention is a device for holding empty aluminum cans in a horizontal position on the ground so that the cans can be smashed flat by driving an automobile tire over the device and the cans. The device consists of a flat backing for the device that is placed against the ground and a flexible member that is secured to a top surface of the backing for holding cans horizontal. The flexible member is provided with a plurality of inwardly concave covers for holding the cans. Each cover secures to the top of the backing and forms a wave-shaped flap that extends over the top of an empty aluminum can that has been inserted under the cover.

The covers are arranged on the backing so that a series of aluminum cans can be placed side by side along the length of the backing, with each of the cans contained under its corresponding cover. The covers are also arranged so that the open edge of each cover faces in the same direction as all of the other open edges of the covers provided on the device. This orientation of cover open edges allows an adjacent unsmashed can and its cover to help hold a can that is being smashed within that can's cover as an automobile tire begins to engage the attached end of the cover and begins to exert a smashing force on the can.

In order to use the device, an empty aluminum can is placed under each of the covers by lifting the open edge of each cover and inserting the can between the cover and the portion of the flexible member that attaches to the top surface of the backing.

The device is then oriented so that the open edges of the covers extend away from the oncoming automobile. The automobile is then moved toward the device and the attached cans until a tire of the automobile runs over them and smashes the cans flat. The automobile is then driven off of the device and smashed cans and the flexible member automatically returns to its original configuration. The smashed cans are then removed from the device via the open edges of the covers and the device is ready to be reloaded with additional empty cans that need to be smashed.

The device is provided with a hole in one end of the backing so that the device can be hung up on a nail when not in use. It is preferably that the hole be provided in the end of the backing toward which the cover openings face in order that the device can be reloaded while it is hanging vertically. With the cover openings facing upward when the device is hanging vertically, the empty cans will be more easily retained under the covers, since they will be forced under the covers by the pull of gravity. When the device is fully loaded with cans, i.e. each of the covers is holding an empty can, the device may be placed adjacent the tires of an automobile so that the tires will smash the cans when the automobile is moved. This device may be used in an automobile garage, a driveway, or any other suitable parking place. The only requirements are that there be a relatively a firm surface on which the backing can be placed so the tires will roll over it and that the path that the tires will take is predictable in order that the device can be properly aligned along that path.

DETAILED DESCRIPTION OF THE PREFERRED EMBODIMENT INVENTION

Figure 1:
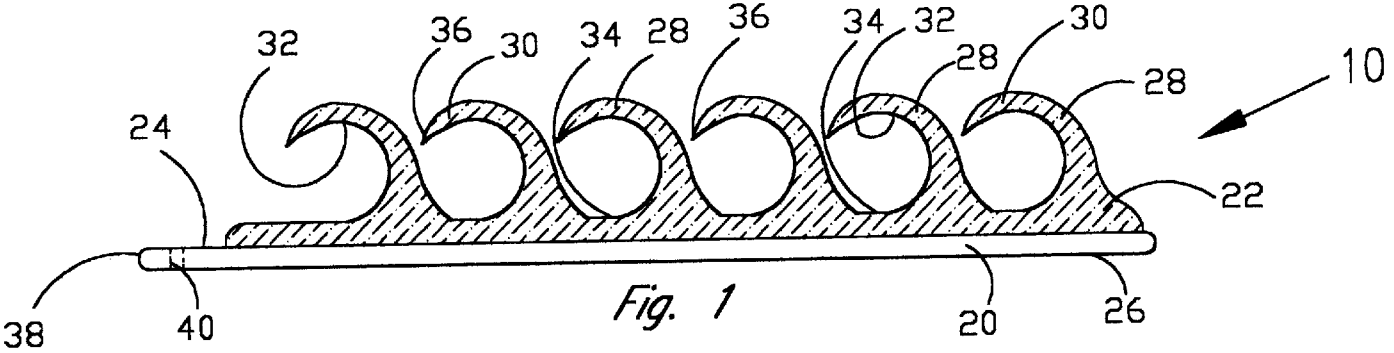
FIG. 1 is a side view of a device for smashing aluminum cans constructed in accordance with a preferred embodiment of the present invention.
Figure 2:
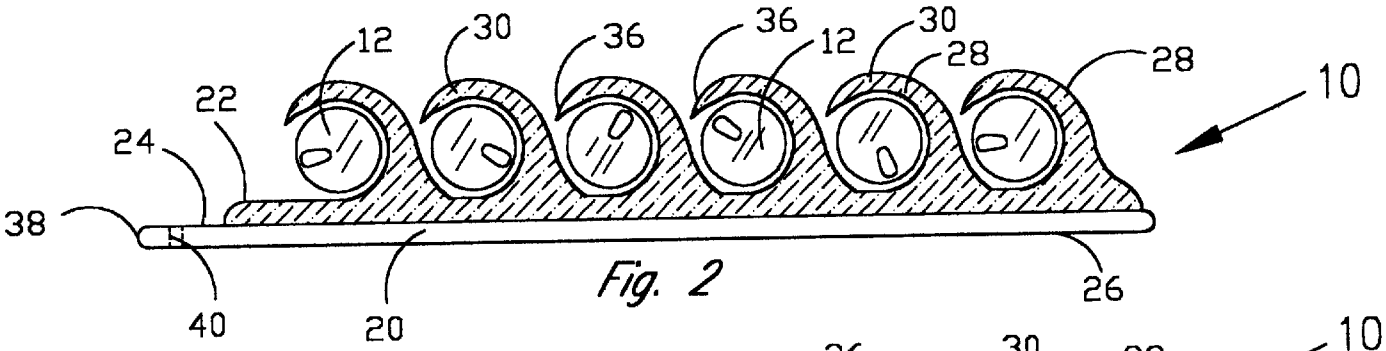
FIG. 2 is a side view of the device of FIG. 1 showing the device loaded with empty aluminum cans.
Figure 3:
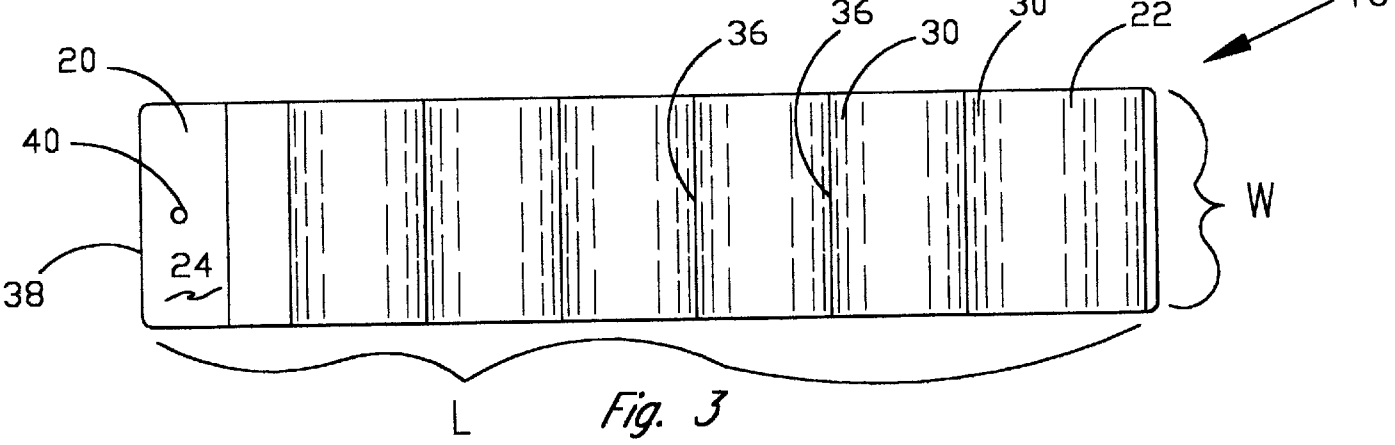
FIG. 3 is a top view of the device of FIG. 1.
Figure 4:
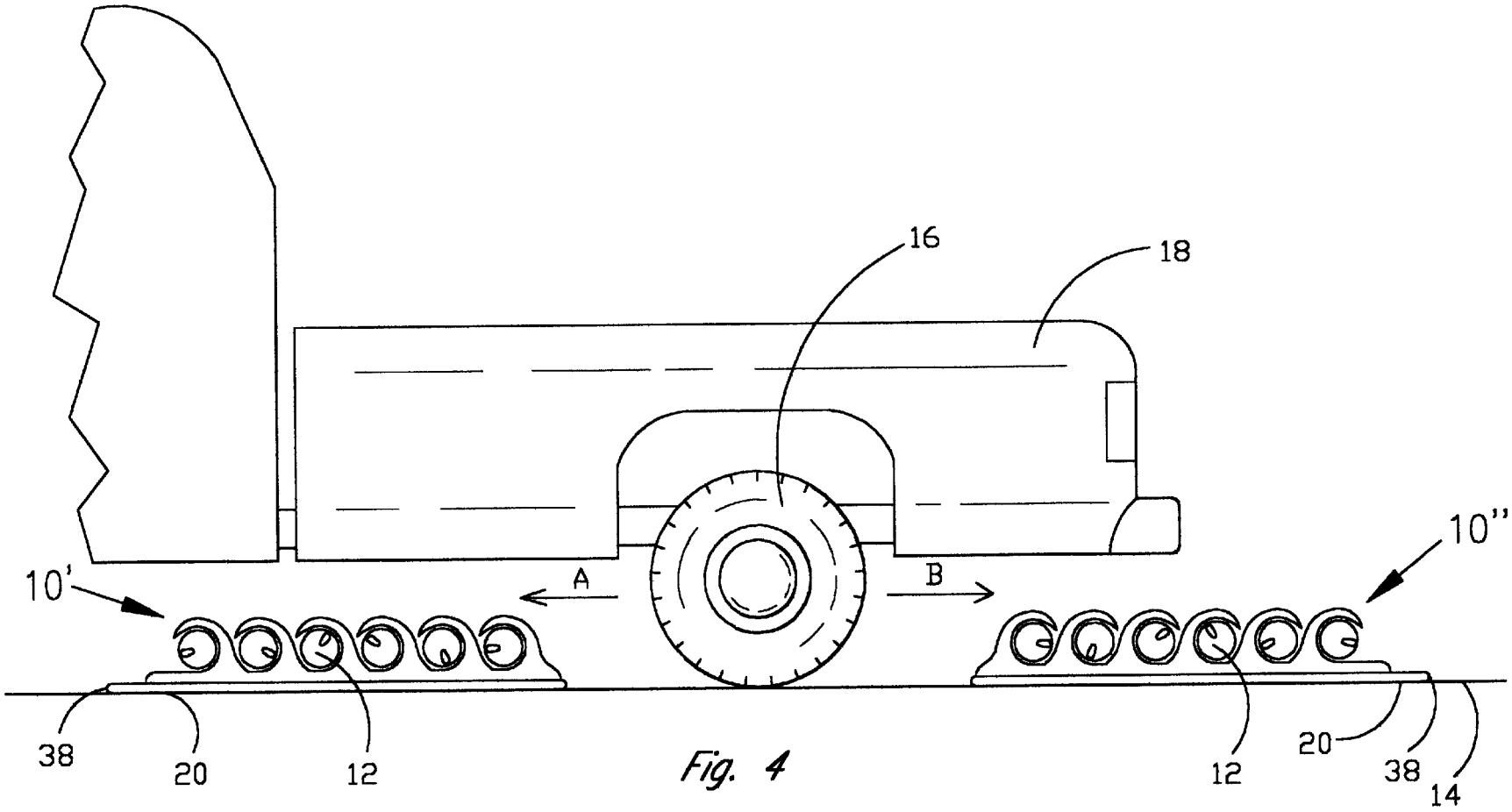
FIG. 4 is a side view of two of the loaded devices of FIG. 2, shown as they would be placed relative to an automobile when the devices were being used to smash cans.

Referring now to the drawings and initially to FIGS. 1–3, there is illustrated a device 10 for smashing aluminum cans 12 that is constructed in accordance with a preferred embodiment of the present invention. As illustrated in FIG. 4, the device 10 is designed to hold empty aluminum cans 12 in a horizontal position on the surface 14 of the ground so that the cans 12 are smashed by driving a tire 16 of an automobile 18 over the device 10 and the attached cans 12.

The device 10 consists of a flat backing 20 and a flexible member 22 for holding cans horizontally against the backing 20. The flexible member 22 secures to a top surface 24 of the backing 20, and the backing 20 is provided with an opposite bottom surface 26 that is placed against the surface 14 of the ground when the device 10 is in use. The flat backing 20 has a length L that is greater than its width W, as illustrated in FIG. 3, and the backing 20 is relatively flat and uniform in thickness along its entire length L. The flexible member 22 is provided with a plurality of inwardly concave covers 28 for holding the cans 12. Each of the covers 28 secures to the top surface 24 of the backing 20 and forms a breaking-wave shaped flap 30. Each of the flaps 30 forms a void 32 between itself and a portion 34 of the flexible member 22 provided under the flap 30. These voids 32 removably receive empty aluminum cans 12, as illustrated in FIG. 2.

The covers 28 are arranged on the top surface 24 of the backing 20 so that several aluminum cans 12 can be placed side by side along the length L of the backing 20, with each of the cans 12 contained under its void 32 and secured therein by its corresponding cover 28. Each flap 30 is provided with an open edge 36 for accessing the void 32. The covers 28 are also arranged so that all of the open edges 36 extend in the same direction and toward a first end 38 of the device 10. This orientation of the open edges 36 allows an adjacent can 12 that has now yet been smashed and its associated cover 28 to help hold a first can 12 that is being smashed within that first can's cover 28 as an automobile tire 16 begins to engage an attached end 40 of the cover 28 for that first can 12 and begins to exert a smashing force on the first can 12.

In order to use the device 10, an empty aluminum can 12 is first placed within each void 32, i.e. one can 12 under each of the covers 28. This is done by lifting the open edge 36 of the flap 30 for each cover 28 and inserting an empty can 12 between the cover 28 and the portion 22 of the flexible member 22 located under the flap 30.

The device 10 is then oriented so that the open edges 36 of the flaps 30 extend away from the oncoming automobile 18. This is illustrated in FIG. 4 by two identical devices 10' and 10". The first device 10' is shown on the left hand side of FIG. 4 and the second device 10" is show on the right hand side of FIG. 4. When the automobile 18 is to move forward in the direction of Arrow A, the first device 10' should be placed in front of the tire 16 and the open edges 36 of the flaps 30 on the first device 10' should extend away from the oncoming tire 16. Alternately, when the automobile 18 is to move in the reverse direction, as illustrated by Arrow B, the second device 10" should be placed in front of the tire 16 and the open edges 36 of the flaps 30 on the second device 10" should extend away from the oncoming tire 16.

The automobile 18 is then driven toward the device 10 and the attached cans 12 until the tire 16 of the automobile 18 runs over them and smashes the cans 12 flat. The automobile 18 is then driven off of the device 10 and the now smashed cans 12. When the automobile 18 is driven off of the device 10, and the flexible member 22 automatically returns to its original configuration. The smashed cans 12 are then removed from the device 10 via the open edges 36 of the flaps 30, and the device 10 is ready to be reloaded with additional empty cans 12 that need to be smashed.

As illustrated in FIG. 3, the device 10 is provided with a hole 40 in the first end 38 so that the device 10 can be hung up on a nail (not illustrated) or other suitable hanging means, when the device 10 not in use. It is preferably that the hole 40 be provided in the first end 38 since this is the end toward which the opening edges 36 face. This allows the device 10 to be reloaded with cans 12 while it is hanging vertically. With the opening edges 36 facing upward when the device 10 is hanging vertically, the empty cans 12 will be more easily retained within the voids 32, since they will be forced under the covers 28 by the pull of gravity.

When the device 10 is fully loaded with cans 12, i.e. each of the covers 28 is holding an empty can 12, the device 10 may be placed in front of or behind the tire 16 of an automobile 18 so that the tire 16 will smash the cans 12 when the automobile 18 is moved. This device 10 may be used on the surface 14 of the ground, on the surface of an automobile garage, on the surface of a driveway, or on any other suitable surface. The only requirement for the surface is that the surface must be relatively firm so that the backing 20 can rest upon it and the cans 12 will be smashed when the tire 16 rolls over them. Also, the path that the tire 16 will take must be predictable in order that the device 10 can be properly aligned along that path. For this reason, it is desirable to place the device 10 very near the tire 16 and to drive the automobile 18 either straight forward or straight backward after the loaded device 10 has been placed adjacent to the tire 16.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A device for smashing empty aluminum cans comprising a backing having a bottom surface for placing against the ground and having an opposite top surface, and a flexible member secured to the top surface, said flexible member being provided with covers for removably securing empty aluminum cans to the flexible member.

2. A device for smashing empty aluminum cans according to claim 1 further comprising each said cover provided with a curved flap that forms a void between the flap and a portion of the flexible member located beneath the flap, said curved flap being inwardly concave so that the void formed thereunder removably receives a horizontally oriented aluminum can, each flap provided with an open edge for removably inserting said can within said void, and all said open edges extending toward a first end of said backing.

3. A device for smashing empty aluminum cans according to claim 2 further comprising said first end of said backing being provided with a hole extending through it as a means for hanging the backing vertically.

4. A device for smashing empty aluminum cans according to claim 3 further comprising the flexible member being resilient so that the covers return to their original configuration each time after being run over by a tire of an automobile.

5. A device for smashing empty aluminum cans comprising a backing having a length and a width, said length exceeding said width, said backing having a bottom surface for placing against a surface and having an opposite top surface, and a flexible member secured to the top surface, said flexible member being provided with covers for removably securing empty aluminum cans to the flexible member and for engagement with a tire of an automobile as the automobile drives over the covers in order to smash the cans secured thereunder, said flexible member being resilient so that it returns to its original configuration after being run over by the tire of an automobile.

6. A device for smashing empty aluminum cans according to claim 5 further comprising each said cover forming an inwardly-concave, curved flap that forms a horizontally oriented cylindrical void between the flap and a portion of the flexible member located beneath the flap, each flap provided with an open edge for removably inserting an aluminum can horizontally within each said void, and all said open edges extending toward a first end of said backing.

7. A device for smashing empty aluminum cans according to claim 6 further comprising said first end of said backing being provided with means for hanging the backing vertically by the first end.

8. A method for smashing empty aluminum cans comprising the following steps:

a. inserting empty aluminum cans through open edges of flaps in a device for smashing empty aluminum cans so that each can enters its own horizontally oriented void provided extending across the width of the device, the device for smashing empty aluminum cans is provided with a backing that lies against the ground and a resilient flexible member that secures to a top surface of the backing so that each can is removably secured in the void created between an overlying flap of a cover provided in the flexible member and between a portion of the flexible member provided below the flap;

b. placing the device on the ground so that a length of the device aligns with an anticipated path of travel for a tire of an automobile and so that all of the open edges of the flaps extend away from the oncoming automobile;

c. driving the automobile over the device so that the weight of the automobile, as exerted by the tire, smashes the cans; and d. removing the smashed cans from the device.

9. A method for smashing empty aluminum cans according to claim 8 wherein steps a–c are performed repeatedly.

* * * * *